United States Patent [19]

Bowen

[11] Patent Number: 4,655,318

[45] Date of Patent: Apr. 7, 1987

[54] STEP ASSEMBLY

[75] Inventor: Harry E. Bowen, Portland, Oreg.

[73] Assignee: H. Bowen Company, Inc., Portland, Oreg.

[21] Appl. No.: 784,808

[22] Filed: Oct. 4, 1985

[51] Int. Cl.[4] ..... E06C 9/04

[52] U.S. Cl. ..... 182/90; 182/228

[58] Field of Search ..... 182/90, 91, 92, 87, 182/82, 228, 93, 46

[56] References Cited

U.S. PATENT DOCUMENTS

| | | | |
|---|---|---|---|
| 1,639,210 | 8/1927 | Brown | 182/90 |
| 1,944,384 | 1/1934 | West | 182/90 |
| 3,374,859 | 3/1968 | Dobert | 182/90 |
| 3,434,747 | 3/1969 | Nichols | 403/345 |
| 3,867,864 | 2/1975 | Knohl | 85/21 |
| 3,974,615 | 8/1976 | Ditcher | 182/92 |
| 4,100,997 | 7/1978 | Peacock | 182/90 |
| 4,195,709 | 3/1980 | Ginnotti | 182/90 |
| 4,365,780 | 12/1982 | Williams | 249/11 |

FOREIGN PATENT DOCUMENTS

| | | | |
|---|---|---|---|
| 2254550 | 5/1973 | Fed. Rep. of Germany . | |
| 2440461 | 7/1980 | France | 182/90 |
| 2115868 | 9/1983 | United Kingdom | 182/92 |

*Primary Examiner*—Reinaldo P. Machado
*Attorney, Agent, or Firm*—Kolisch, Hartwell & Dickinson

[57] ABSTRACT

A manhole step assembly including a substantially U-shaped metal rod and a corrosion resistant covering molded about the rod is taught. The covering has a tapered portion formed at the free ends thereof, and the tapered portion has a roughed surface to increase the surface area of compression which is used to hold the step in place in the wall of a manhole shaft. A socket which may be cast in such a shaft is also disclosed.

20 Claims, 6 Drawing Figures

STEP ASSEMBLY

BACKGROUND AND SUMMARY OF THE INVENTION

1. Field of Invention

This invention relates to a preformed step for use in a manhole and more particularly to such a step which includes a specially designed surface for retaining the step in a side of a manhole shaft.

2. Description of the Prior Art

The prior art includes a number of steps intended for use in manholes. Such a step is described in U.S. Pat. No. 4,100,997 to Peacock which includes a pair of free ends having a plurality of circular rings which are tapered and deformable and are operable to retain the step in place in the wall of a manhole shaft. Such rings, while operable for their intended use, increase the production cost of the step and may, after a period of time become relaxed thus allowing the step to loosen, causing a safety hazard to a person using the step. Additionally, such rings provide for relatively small surface area which is in contact with the shaft. Use of such rings for manhole steps are disclosed in German Patent No. 2,254,550, in U.S. Pat. No. 4,195,709 to Gianotti et al., and in U.S. Pat. No. 3,374,859 to Dobert.

An object of the instant invention is to provide an improved step which would be more securely retained in a side wall of a manhole shaft.

Another object of the instant invention is to provide a step having an increased surface area which will be operable to hold the step in a side wall of a manhole shaft.

Yet another object of the instant invention is to provide a step which will remain in place over an extended period of time.

Still another object of the instant invention is to provide a step which is usable with or without a socket molded in a manhole shaft.

Another object of the instant invention is to provide a manhole step assembly which is usable with both wet mix and dry mix concrete and will remain in place with either type of mix.

Another object of the instant invention is to provide a step assembly which will be inexpensive and easy to manufacture, and which will be durable in its intended environment.

SUMMARY OF THE INVENTION

The instant invention relates to a manhole step assembly which includes a substantially U-shaped metal rod which is enclosed in a corrosion resistant covering, which is molded about the rod. The covering has a tapered portion formed at the free ends thereof and the tapered portion has a roughed surface which increases its surface area.

A socket for receiving the free end of the step is also disclosed. The socket includes a socket body which has a substantially frusto-conical form, the inner surface of which has a taper substantially equal to the tapered free end of the step. The socket body has a web extending over its small end for closing the small end and an inner surface including a roughed portion having multiple projections thereon, which complement the projections on the roughed portion of the step assembly.

These and other objects and advantages of the instant invention will be more fully understood as the description of which follows is read in conjunction with the drawings.

A BRIEF DESCRIPTION OF THE DRAWINGS

DESCRIPTION OF THE PREFERRED EMBODIMENT

Figure 1:
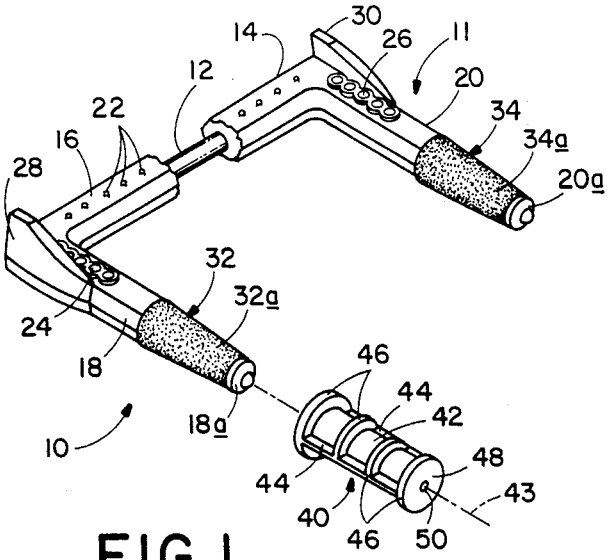
FIG. 1 is a perspective view of a step assembly constructed according to the instant invention, with a portion broken away to show detail.
Figure 2:
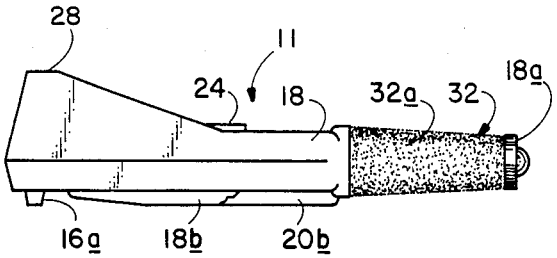
FIG. 2 is an enlarged side view of a step of FIG. 1.
Figure 3:
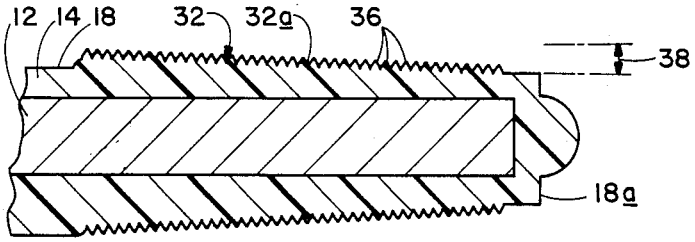
FIG. 3 is an enlarged median cross section view of a tapered portion of the step of FIG. 2, with protrusions on a roughened surface of that portion being exaggerated in size for illustration purposes.

Turning initially to FIGS. 1, 2 and 3, a manhole step assembly is shown generally at 10. Assembly 10 includes a step 11 which has a U-shaped inner metal rod, partially shown at 12. Rod 12, in the preferred embodiment, is formed from a one-half inch diameter, grade 60, steel reinforcing bar. Rod 12 conforms to the requirements of ASTM A-615.

Rod 12 is covered with a conventional, corrosion resistant covering, shown generally at 14. Covering 14 is formed about rod 12 in an injection molding process. In the preferred embodiment, covering 14 is formed of polypropylene and meets the requirements described in ASTM D-2146-D, type II, grade 43758.

The environment in a manhole can be extremely caustic, particularly if the manhole is located in an industrial area. An unprotected metal step may have a short usable life before it must be replaced. The provision of covering 14 significantly increases the life expectancy of the step.

The step assembly includes a step portion 16 and a pair of support members 18, 20, which project outward therefrom and have free ends **18*a*, 20*a*, respectively. Step portion 16 has a non-slip surface formed thereon, which in the preferred embodiment, takes the form of upwardly extending nubs 22. Another form of non-slip surface is provided along support members 18 and 20, and, in the preferred embodiment, take the form of a series of overlapping rings 24, 26. Side guards 28, 30 are provided to prevent lateral slipping of a foot placed on the step. Stiffeners 16*a*, 18*b* and 20*b* are provided on the lower side of portion 16 and members 18, 20**, respectively.

Step 11 has, at its free ends, tapered portions 32, 34. Portions 32 and 34 each have a friction enhancing area **32*a*, 34*a***, respectively. The friction enhancing area, in the preferred embodiment, includes a granular or roughed surface which increases the surface area of the tapered portion thereby providing a greater surface area which may be compressed when the step is installed.

Referring now to FIG. 3, free end **18*a* is shown greatly enlarged. Area 32*a* includes multiple projections, such as those shown at 36 (shown in exaggerated form in the drawing), which extend outward from the surface of portion 32. While projections 36 are quite small, they tend to have a substantially triangular cross-section because tapered portion 32, 34** are fabricated in a mold having indentations formed with a triangular cross-sectioned tool.

In the preferred embodiment, projections 36 are sized and distributed over the tapered portions of the step in a density which corresponds to a sand paper roughness rating of between 10 and 80 grit. Ideally, projections 32 would be sized and distributed at a rating of about 20 grit (coarse), thereby increasing the available surface area which contact a hole formed in the side of a manhole casing into which portions 32, 34 are inserted to place the step in its desired location.

Tapered portion 32, as shown at 38 in FIG. 3, has a taper of, in the preferred embodiment, 2.5 degrees. Such a taper has been empirically determined and is known to both facilitate installation and insure retention of assembly 10 in its desired location, while also allowing removal of the step should such removal be necessary.

Figure 4:
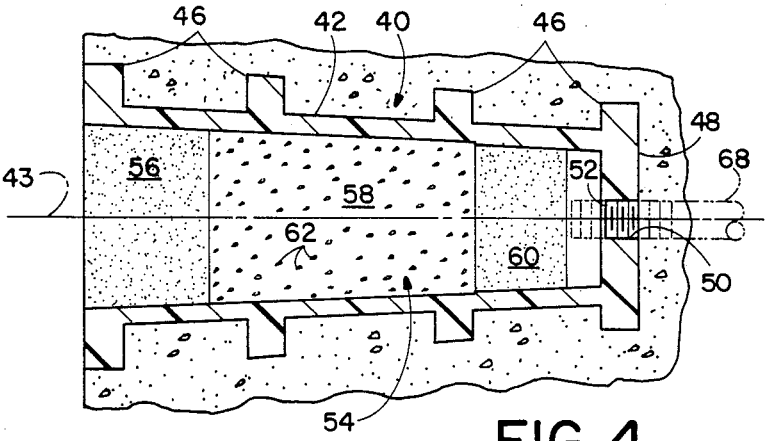
FIG. 4 is an enlarged median cross section view of a socket of FIG. 1 positioned in a concrete wall.

Turning now to FIGS. 1 and 4, a socket 40 for receiving a free end of the step is depicted. Socket 40 includes a body 42 having a longitudinal rib 44 on either side thereof and concentric ribs 46 extending about the outside thereof. Ribs 44 and 46 are provided to secure socket body 42 in a concrete shaft wall.

Body 42 is a substantially truncated conical section, having the same taper as tapered portion 32, 34, which, in the preferred embodiment, is 2.5 degrees.

The conical section of body 42 has a central axis 43 extending through its center.

A web 48 extends across the small end of body 42 for closing the end. Web 48 is substantially perpendicular to axis 43. A threaded tap 50 is provided in web 48 to allow socket 40 to be secured to a concrete form. Web 48 includes a frangible portion 52 adjacent the end of tap 50.

Socket 40 includes a roughed portion, shown generally at 54, which cooperates with the friction enhancing areas on step 11 to retain step 11 in a side wall of a manhole shaft. Portion 54, in the preferred embodiment, is of uniform roughness along the entire inner length of socket body 42. Projections, such as projections 62, extend inward towards the center of body 42 and, in the preferred embodiment, have a roughness rating of less than 40 grit, generally complementing the roughness rating on the tapered portion of the step.

Portion 54 may, however, include plural segments, such as an entry segment 56, and intermediate segment 58 and a terminal segment 60. Again, each segment has multiple projections which extend inwards the center of body 42, and are distributed in the various segments in densities corresponding to certain roughness ratings. The entry and terminal segments may have roughness ratings, as previously described in conjunction with the friction enhancing area, corresponding to between 40 and 80 grit (rough). The intermediate segment may have a roughness rating of less than 40 grit, and would generally complement the roughness rating on the tapered portion of the step.

Figure 5:
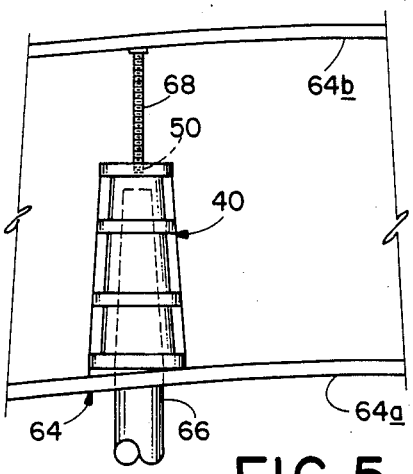
FIG. 5 is a top view of an apparatus for positioning the sockets of the invention, with portions broken away in order to show detail.

Turning now to FIG. 5, a socket 40 is depicted positioned for pouring concrete in a concrete form 64, having an inner form 64*a* and an outer 64*b*. Socket 40 is held in place with a plug 66, which extends through inner form 64*a* and into the hollow interior of the socket. A spacer pin 68 extends to outer form 64*b* and into tap 50 of socket 40.

Socket 40, in the preferred embodiment, is approximately three and three-quarter inches in length. A wall of a manhole shaft may be four to twelve inches thick. Thus spacer pins 68 may be selected to extend through tap 50, breaking web 52 (as shown in phantom lines in FIG. 4), thereby holding socket 40 on plug 66 while concrete is poured into form 64. This is particularly important in a case when a dry mix concrete is used which must be vibrated into place. Such vibration could dislodge an unsecured socket and thereby cause a misaligned condition to exist between a pair of sockets, which would be positioned in a manhole shaft to receive step 11.

Figure 6:
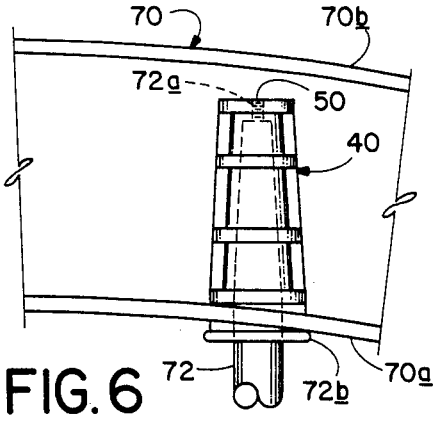
FIG. 6 is a top view of another form of an apparatus for positioning the sockets of the invention, with portions broken away in order to show detail.

Turning now to FIG. 6, a socket 40 is depicted positioned for pouring concrete in a concrete form 70. Form 70 has an inner form 70*a* and an outer form 70*b*. A plug 72 includes a threaded portion 72*a* which is threaded into tap 50, after frangible portion 52 has been removed. A flange 72*b* abuts inner form 70*a*. Plug 72 is suitable for holding sockets 40 in place when forming a manhole shaft with either wet or dry mix concrete.

Pin 68 and plug 72 comprise what is referred to herein as threaded means for holding a socket in place.

In the case where sockets 40 are placed in a form which is to be filled with a wet mix concrete, spacer pins 68 may not be required and the sockets will be held in place by plugs 66. The presence of web 52 serves to prevent the entry of wet concrete into the interior of socket 40.

OPERATION OF THE DEPICTED EMBODIMENT

While it is believed the above description of the preferred embodiment is sufficient to permit one skilled in the art to practice the invention, a brief description of the intended operation of that embodiment will now be set forth.

To prepare a manhole shaft for the assembly, as shown in FIG. 5, socket 40 will be provided with a spacer pin 68 which is designed to prevent movement of socket 40 away from inner form 64*a*. Plug 66 is placed through an opening in inner form 64*a* to hold socket 40 in the proper position. Spacer pins 68 may be adjusted to provide a snug fit between the large end of socket 40 and inner form 64*a*.

Turning now to FIG. 6, a socket 40 is positioned adjacent inner form 70*a* and plug 72 is threaded into tap 50. Frangible portion 52 may be removed before such placement, or the threaded portion 72*a* of plug 72 may be provided with a sharpened point which will pierce portion 52. Plug 72 is rotated until socket 40 is brought snug against inner form 70*a*. Plug 72 is held against inner form 70*a* by flange 72*b*.

Although both wet and dry mix concrete are vibrated to provide maximum concrete density, the vibration required to compact a dry mix concrete is more intense than that required for the wet mix. In either case, retention of socket 40 as discribed in conjunction with FIGS. 5 and 6 provides that the socket will remain in place during the vibration process.

In the case of a dry concrete casting, once the concrete is in place, the plugs may be removed and the inner forms withdrawn from the casting. The casting is then allowed to cure.

If step assembly 10 is being used with a wet concrete mix, the sockets may be positioned within the forms prior to pouring the concrete into the form. After the wet mix concrete is poured into the form and allowed to set, the plugs may be removed and the forms removed from the casting.

As previously noted, the walls of a manhole shaft may be as little as four inches thick, or may be up to a foot thick, generally depending upon the inside diameter of the manhole shaft. Provision of a plug and spacer pin arrangement or a plug having a threaded portion on the end thereof will generally be required if the thickness of the wall of the manhole shaft is greater than four inches.

In the case of a four-inch thick shaft wall, socket 40 will generally remain in place on a plug, such as plug 66, without the provision of spacer pins 68 or a threaded portion on the end of the plug.

When the shaft sections have been positioned in a manhole, steps 11 may be positioned in the socket pairs. Such positioning is easily accomplished by inserting tapered portions 32, 34 into sockets 40 and then driving the step into place with a hammer or mallet. The complementing roughened surfaces in the interior of the socket and on the tapered portions engage to fix the step in place. The provision of the protrusions on the inner surface of the socket and the tapered portion of the step result in an increased surface area for each component of the assembly and thereby enhance the retentive forces between the step and the socket.

Thus a manhole step assembly has been disclosed which provides for easy installation of corrosion resistant steps in a manhole. The steps have been demonstrated to support a substantial vertical load. A socket for receiving a portion of the step, which is intended to be cast in a concrete form has also been disclosed. Although the step is intended for use with such a socket, it should be understood that the drilling of a hole in a precast concrete manhole liner would also facilitate placement of steps constructed according to the invention. Such drilled holes may be left as is, or may be provided with an insert, which may be similar to the socket described herein.

Although a preferred embodiment of the invention has been disclosed, it should be understood that certain variations and modifications may be made thereto without departing from the spirit of the invention.

It is claimed and desired to secure by Letters Patent:

1. A manhole step assembly comprising:

a substantially U-shaped metal rod; and a corrosion resistant covering molded about said rod, said covering having a tapered portion formed at the free ends thereof, said tapered portion including multiple non-circumferentially extending projections integral therewith and extending outwardly therefrom, to increase the surface area thereof.

2. The assembly of claim 1 wherein each of said projections has a substantially triangular cross-section.

3. The assembly of claim 2 wherein said projections are sized and distributed over said tapered portion such that the surface of said tapered portion is between about 10 and 80 grit.

4. The assembly of claim 3 wherein said surface is about 20 grit.

5. The assembly of claim 1 wherein said tapered portion has a taper of about 2.5 degrees.

6. The assembly of claim 1 which further includes a socket for receiving one of the free ends, said socket being constructed for placement in a concrete form prior to pouring concrete therein, said socket being hollow and having a substantially frusto-conical form and a central axis, and a taper equal to that of said tapered portion.

7. The assembly of claim 6 wherein said socket includes a web extending substantially normal to said central axis for closing the small end thereof, said web having a threaded tap therein to facilitate placement of said socket in the form, said tap extending coaxial with said central axis.

8. The assembly of claim 7 wherein said web includes a frangible portion abutting said tap.

9. The assembly of claim 6 wherein said socket includes plural ribs distributed along its outer surface.

10. The assembly of claim 6 wherein the inner surface of said socket includes a roughed portion having multiple projections thereon extending inwards towards said central axis.

11. The assembly of claim 10 wherein said socket roughed portion includes plural segments having various roughness ratings.

12. The assembly of claim 11 wherein said segments include an entry segment and a terminal segment, each having a predetermined roughness rating, and an intermediate segment having a roughness rating less than that of said entry and terminal segments.

13. A manhole step assembly for placement into solid material lining a manhole comprising:

a substantially U-shaped metal rod; and a corrosion resistant covering molded about said rod, a portion of the covering molded about the base of the U forming a step portion and the portion of the covering molded about the arms of the U forming support members, the free ends of the support members being tapered and having a friction enhancing portion, including a granular surface, molded thereon.

14. The assembly of claim 13 wherein said granular surface has a roughness rating of between about 10 and 80 grit.

15. The assembly of claim 13 wherein the improvement further includes a socket for placement in holes formed in the solid material, said socket having a substantially frusto-conical form with a taper equal to that of said tapered free end, the inner surface of said socket including a granular surface complementing that on said tapered free ends of the step, the socket further including a web for closing the small end thereof.

16. The assembly of claim 15 wherein said granular surface of said socket includes multiple projections distributed along said inner surface having various roughness ratings, wherein the projections are distributed in an entry segment located adjacent to the large end of said socket, and a terminal segment located adjacent the small end of said socket, each having a roughness rating of between about 40 and 80 grit, and wherein projections are further distributed in an intermediate segment located between said entry segment and said terminal segments and having a roughness rating of less than about 40 grit.

17. The assembly of claim 15 wherein said socket includes plural ribs distributed along its outer surface for securing said socket into the solid material.

18. The assembly of claim 15 wherein said web includes a threaded tap therein to facilitate positioning of said socket to a concrete form.

19. The assembly of claim 18 wherein said web includes a frangible portion abutting said tap.

20. The assembly of claim 19 which further includes threaded means receivable in said threaded tap for holding said socket in place.

* * * * *